United States Patent [19]

Dimijian

[11] Patent Number: 4,970,877

[45] Date of Patent: Nov. 20, 1990

[54] ICE FORMING APPARATUS

[75] Inventor: Berge A. Dimijian, 919 S. Highland Ave., Los Angeles, Calif. 90036

[73] Assignees: Berge A. Dimijian; Beverly Rodeo Development Corporation, ; a part interest

[21] Appl. No.: 495,770

[22] Filed: Mar. 19, 1990

Related U.S. Application Data

[60] Division of Ser. No. 438,031, Nov. 24, 1989, which is a continuation-in-part of Ser. No. 311,765, Feb. 17, 1989, Pat. No. 4,899,548.

[51] Int. Cl.[5] ..... F25C 1/12

[52] U.S. Cl. ..... 62/344; 62/348

[58] Field of Search ..... 62/347, 348, 344, 352, 62/73, 74; 210/483, 497.01

[56] References Cited

U.S. PATENT DOCUMENTS

| | | | |
|---|---|---|---|
| 902,349 | 10/1908 | Toninetti | 210/497.01 X |
| 1,350,229 | 8/1920 | Lee | 210/497.01 X |
| 3,100,928 | 8/1963 | Bryand | 210/497.01 X |
| 3,246,481 | 4/1966 | Douglas et al. | 62/347 X |
| 3,962,097 | 6/1976 | Ruman et al. | 210/497.01 X |
| 4,019,987 | 4/1977 | Krasnow | 210/483 X |

*Primary Examiner*—William E. Tapolcai, Jr.
*Attorney, Agent, or Firm*—William W. Haefliger

[57] ABSTRACT

Ice making apparatus includes surfaces on which ice pieces form when water is sprayed on those surfaces, a water reservoir and a pump to pump water from the reservoir for spraying onto those surfaces, and a pressure sensitive control which responds to pressure of water in the reservoir, communicated via an air duct to a pressure switch, to control operation of the pump, the switch being adjustable to adjust the sizes of ice pieces formed on the surfaces.

1 Claim, 5 Drawing Sheets

ICE FORMING APPARATUS

This application is a division of Ser. No. 438,031 filed Nov. 24, 1989, which is a continuation-in-part of Ser. No. 311,765 filed Feb. 17, 1989, now U.S. Pat. No. 4,899,548.

BACKGROUND OF THE INVENTION

This invention relates generally to formation of ice pieces, and more particularly, to simple, reliable, low cost apparatus to automatically produce ice pieces.

Prior apparatus to accomplish the above objective has been characterized by excessive cost and complexity leading to unreliability. There is need for improved apparatus, which is simple and effective, to produce ice, automatically, with minimum parts.

SUMMARY OF THE INVENTION

It is a major object of the invention to provide improved apparatus meeting the above need. Such apparatus typically includes (a) a plate forming a plurality of through openings, the plate having an under surface facing downwardly, (b) a plurality of evaporator tips projecting downwardly from the openings, the tips consisting of heat conductive metal, (c) there being downwardly tapering thermal isolators surrounding the tips proximate the plate, (d) first means for supplying refrigerant fluid to extract heat upwardly from at least some of the tips and thereby cool them to ice forming temperature, (e) second means to spray water onto the under surface of the plate to drain down the isolators onto the tips, whereby ice progressively forms on the tips, and the tips may be subsequently heated to effect release of the ice from the tips to drop downwardly, for harvesting.

As will be seen, the tips are typically integral with or carried by the plate, are hollow, and the first means typically includes ducting positioned to extend over the tips so that refrigerant flows in heat extracting relation with the tips.

It is yet another object to provide simple ice forming and releasing tips that have downwardly conical surfaces, the downwardly tapering isolators having surfaces extending closely about the tips, above the lowermost extends thereof, to prevent ice formed on the tips from clinging to the plate.

It is a further object to provide a system to alternately flow cold refrigerant and warm fluid to and through flow ducting, the warm fluid heating the tips to release ice that forms on them when refrigerant flows through the ducting.

Additional objects include the provision of a spray head located beneath the plate, and angled to direct the spray laterally and upwardly to impinge upon plate extends between the tips for drainage onto the tips; the provision of a chute located beneath the tips to receive the ice dropping off the tips and to direct the received ice toward a lower collection zone, and a housing extending about the ducting, plate, chute, and the collection zone; and the provision of a sensor projecting toward a zone of ice formation adjacent one of the tips, and a valve operatively connected with the sensor to switch the supply of refrigerant, when ice forms to a thickness to contact the sensor, to supply warm refrigerant instead of cool refrigerant, and to switch the supply of refrigerant, when ice has released from the tips to supply cool refrigerant instead of warm refrigerant.

A further object is to provid improved reservoir water level control of ice pieces in a very simple and convenient manner.

These and other objects and advantages of the invention, as well as the details of an illustrative embodiment, will be more fully understood from the following specification and drawings, in which:

DRAWING DESCRIPTION

DETAILED DESCRIPTION

Figure 1:
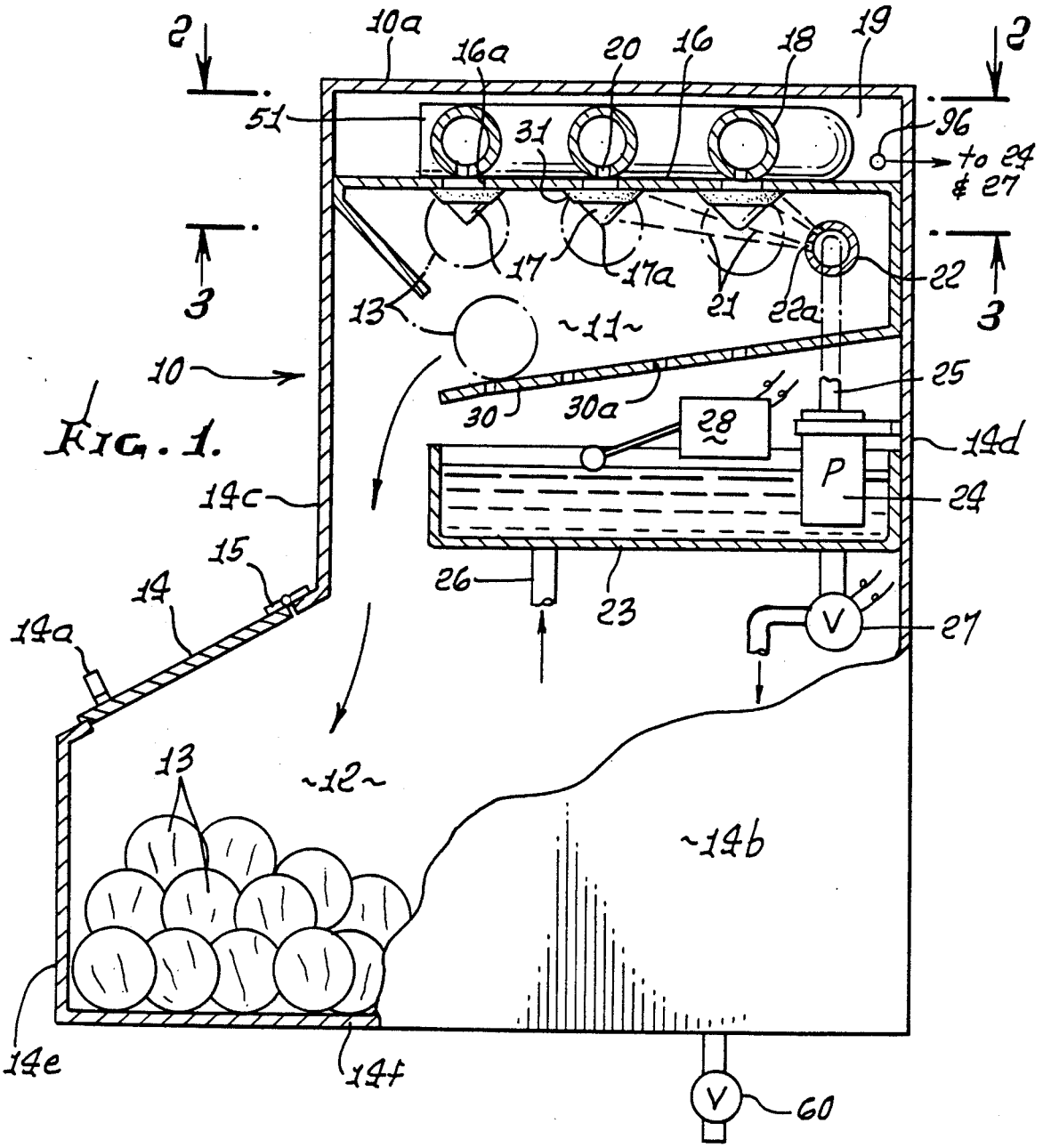
FIG. 1 is an elevation in section showing apparatus embodying the invention.

In FIG. 1, a housing 10 surrounds an upper region 11 wherein ice is generated, and a lower region 12 wherein ice, which has fallen from region 11, is collected or harvested. Ice pieces 13 in region 12 are accessible by lifting a door 14, hinge mounted to the housing at 15. A door handle appears at **14*a*. Housing walls appear at 14*b*–14*e***.

Figure 3:
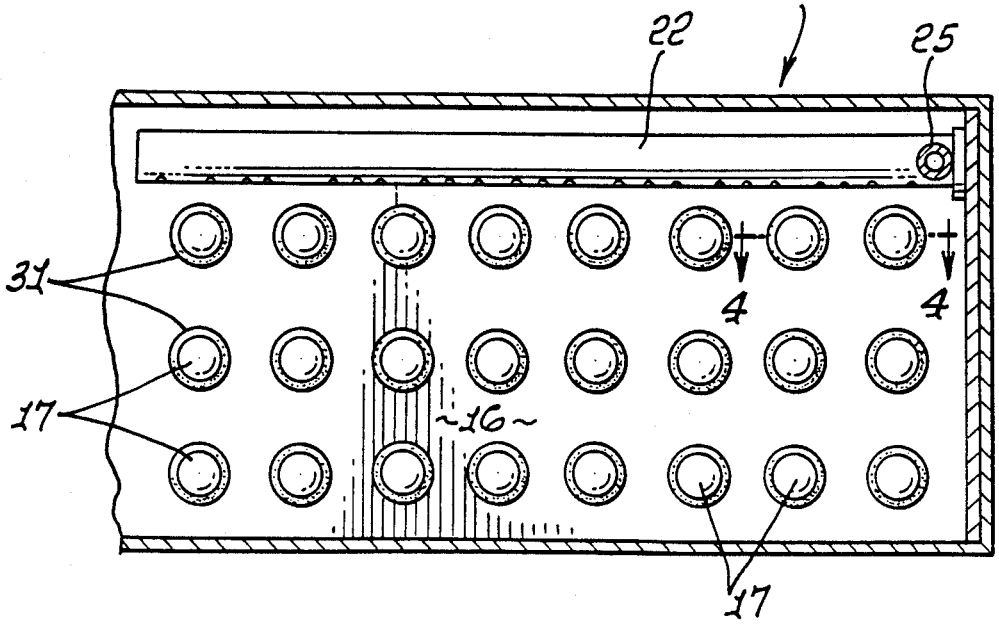
FIG. 3 is a view taken on lines 3—3 of FIG. 1.
Figure 4:
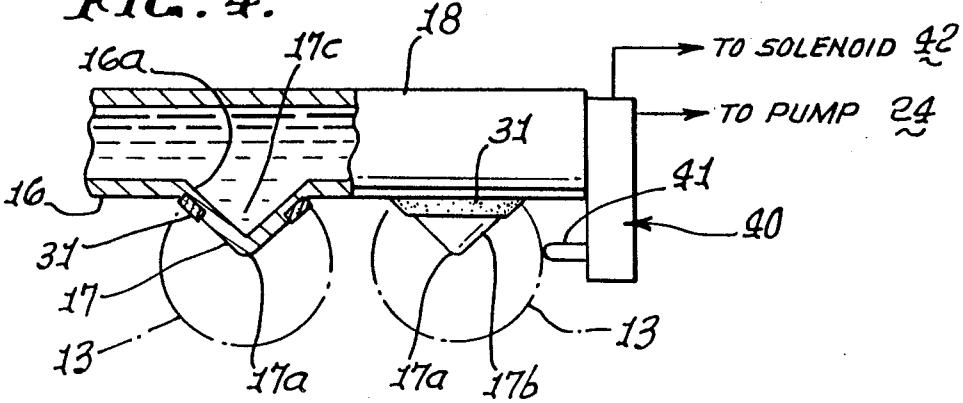
FIG. 4 is an enlarged fragmentary section taken on lines 4—4 of FIG. 3.

Located in region 11 is a horizontal plate 16, spaced below the top wall **10*a* of the housing. Plate 16 is carried by the housing and supports a multiplicity of metallic tips 17, typically extending in rows and columns as seen in FIG. 3. The tips may be formed integrally with the plate 16, as seen in FIG. 4, and depend from the plate to have lowermost apices at 17*a*. The tips typically have downwardly tapering, conical surfaces 17*b*, and are hollow as at 17*c* below openings 16*a* in the plate. If the tips are not part of the plate, they are carried by the plate as in FIG. 1. Refrigerant supply means in the form of ducts 18 extend in space 19 above plate 16 and below top wall 10*a*. Such ducts have lowermost openings 20 to communicate refrigerant 21 to the hollow interiors of the hollow tips, thereby to cool the tips to below ice forming temperature. In FIG. 4, the openings 20 coincide with openings 16*a*. A header 50 supplies refrigerant to the ducts, and a header 51** receives refrigerant from the ducts.

Second means is also provided to spray water streams 21 laterally and upwardly onto the underside of the plate 16. Such means is shown in the form of a spray nozzle or nozzles 22 below plate 16 and having an outlet or outlets **22*a* angled to direct the streams 21 as shown. Water is supplied to the nozzle or nozzles from a reservoir 23, and via a pump 24 and a line 25 leading from the pump to the nozzle or nozzles. Water is received into the reservoir via duct 26, and discharged to the exterior, as described in FIG. 7. A control 28 for valve 27 and pump 24 is responsive to water level in the reservoir. See also FIG. 7. The reservoir is located beneath an inclined plate 30 acting as a chute to direct dropping ice pieces toward lower region 12, referred to above. Plate 30 is perforated at 30***a*, and may be a grid.

Located on the tips are downwardly tapering, thermal isolators 31, which may surround upper extends of the downwardly tapering tips, and are spaced above apices 17*a* as well as above downwardly tapering conical surfaces 17*b*. Surfaces 31 may have the form of cone frustums for effectively preventing clinging of isolator ice to the plate 16. They may be formed by plastic, annular frustums bonded to the metallic isolators to be substantially surface flush therewith.

In operation, water sprayed onto the under surface of plate 16 between the tips drains down over the surfaces 31, and 17*b* in succession, toward apices 17*a*, forming ice pieces 13, generally spherically shaped due to the insulated frustrum-shaped surfaces 31 which tend not to conduct heat from the draining water to the refrigerant, and which tend not to retain or hold the ice. Thus, the ice formed on the tips is primarily located and retained below the insulative rings 31, and clings to surfaces 17*b* as ice builds up; at the same time, the surfaces 31 and 17*b* are so shaped as to readily release the ice to drop downwardly once the tips are warmed, as described below.

When the ice builds up to predetermined size, a sensor senses that build up and effects stoppage of cold refrigerant supply to the tips, and substitutes flow of warm refrigerant fluid to the hollow interiors of the tips to warm them and quickly effect release of ice pieces. The latter drop onto the chute or plate 30, which directs the ice to region 11. The ice pieces are of uniform shape, due to the functioning of surfaces 31 and the conical shape of the tips.

Figure 5:
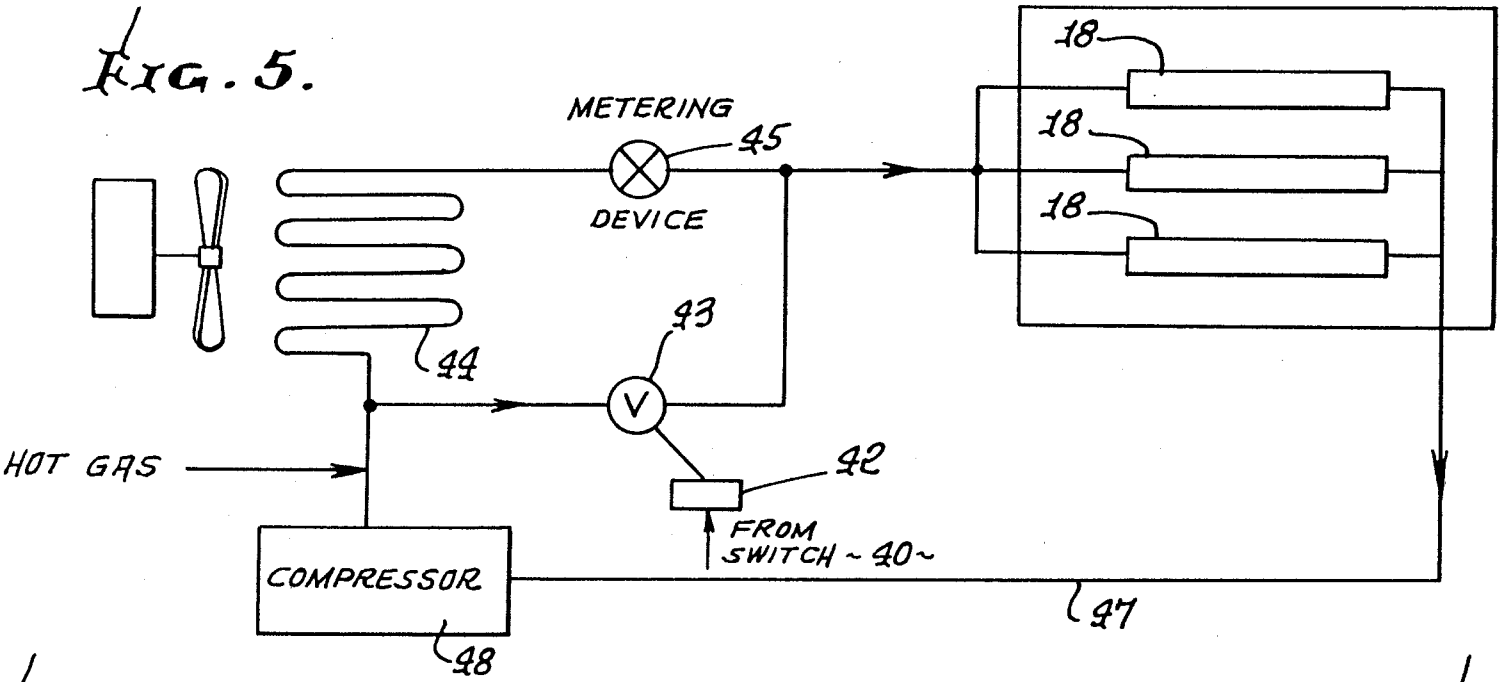
FIG. 5 is a refrigerant system flow diagram.

One form of sensor is indicated at 40 in FIG. 4 in the form of a switch having a plunger 42 that is pushed laterally as ice builds up to close the swtich. Referring to FIG. 5, the switch 40 controls a solenoid 42, which operates a valve 43 in the refrigerant system. When valve 43 is closed, compressed refrigerant passes to coil 44 wherein it is cooled and liquified, and then expands at 45 to refrigerating temperature to flow as gas through the ducts 18 for refrigerating the tips 17, as described. The refrigerant then flows back at 47 to the compressor 48, completing the cycle. Pump 24 is also operating during this time.

When valve 43 is opened by switch 40, due to sensed ice build up to desired size, warm, compressed, refrigerant gas flows directly to the ducts 18 to quickly release the ice from the tips, the response time being quite short. After such release, the sensor plunger 42 returns to extended position and causes switch 40 to operate solenoid 42 to close valve 43, initiating the next ice build-up cycle. Any refrigerant liquid collecting in the hollow tips quickly evaporates to be swept out by refrigerant gas.

Any water draining to the bottom of the housing may be drained at 60, at housing bottom wall 14*f*.

Figure 6:
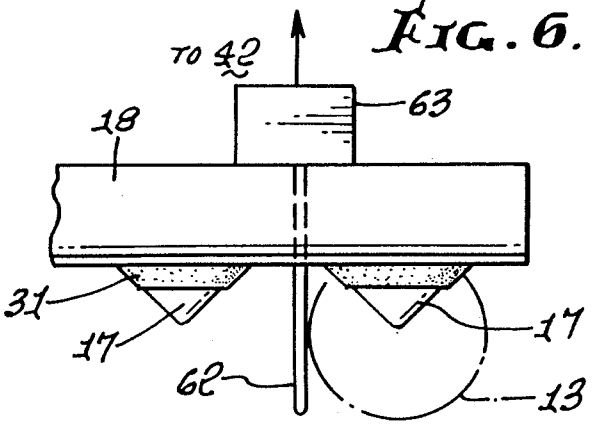
FIG. 6 is a view like FIG. 4 showing a modification.

FIG. 6 shows an alternate form of sensor, i.e., a temperature sensor rod 62 projecting adjacent a tip 17. Built-up ice contacts the rod 62 and operates a temperature-sensitive switch at 63. The latter is connected to solenoid 42.

Figure 7:
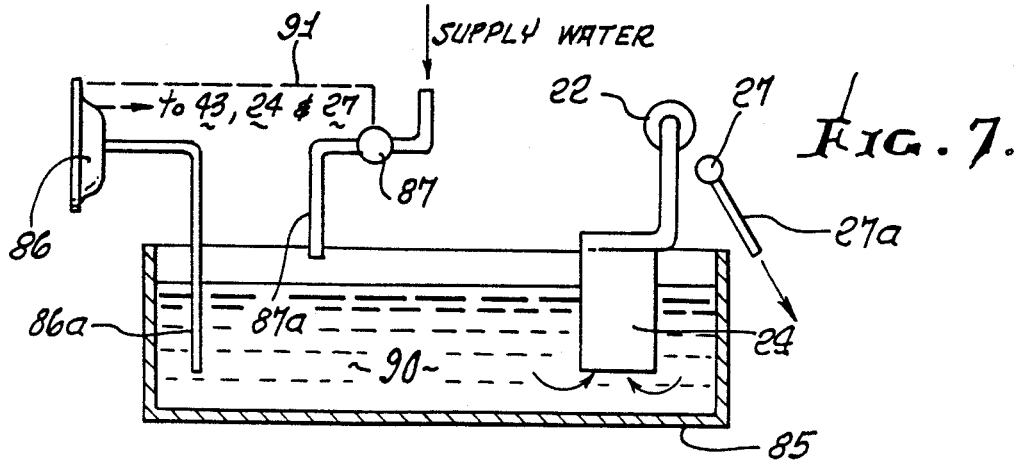
FIG. 7 is a vertical section showing an alternate water supply and a cycle control system.
Figure 2:
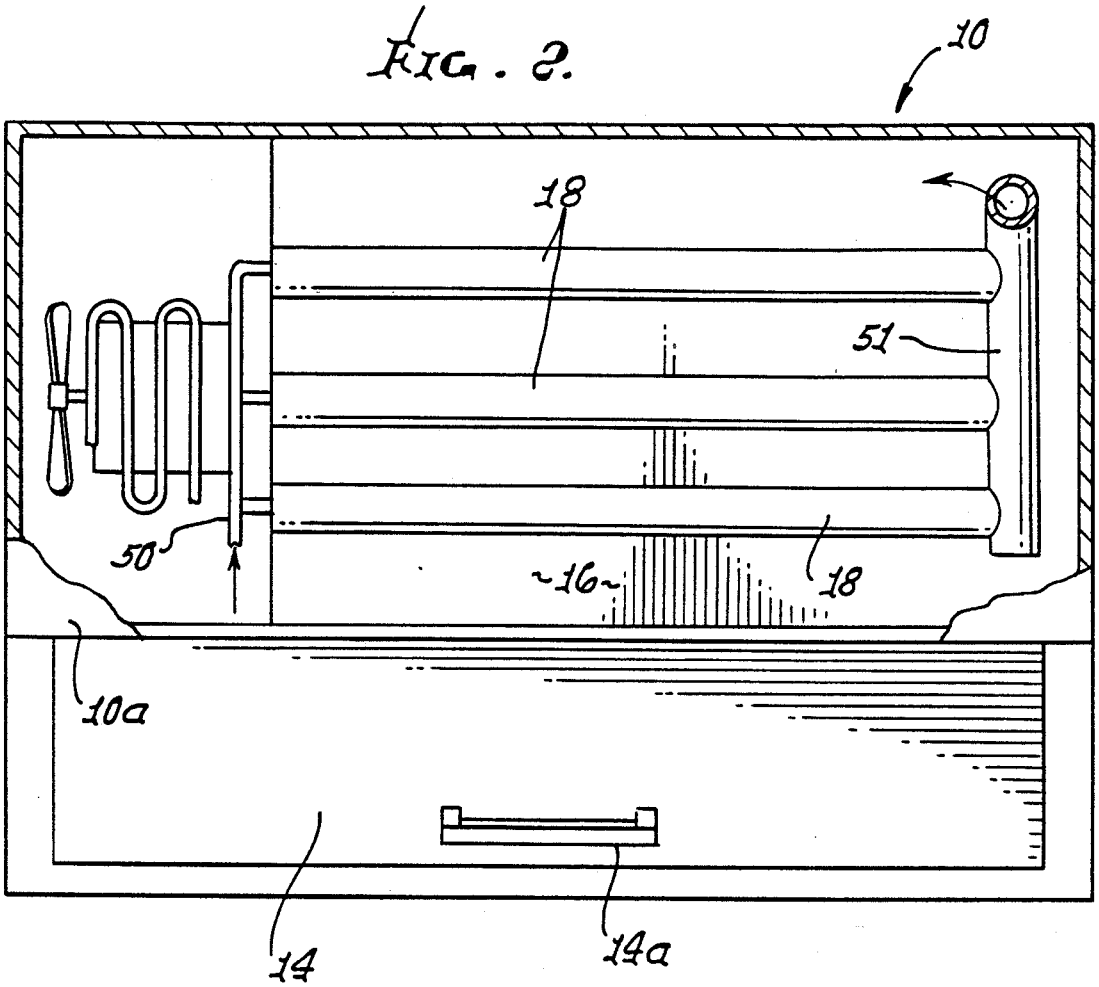
FIG. 2 is a top plan view in section on lines 2—2 of FIG. 1.

FIG. 7 illustrates a means for controlling cycling of the system. As shown, water is supplied to reservoir 85 via a control valve 87 and piping 87*a*. As the level of water 90 in the reservoir (which corresponds to reservoir 23) rises, its level is sensed by pressure switch 86. (Pressure sensing means 86*a* extends into the reservoir water as shown) when the water level reaches a pre-set upper limit, the switch 86 operates to close valve 87. See signal connection line 91. Also, hot gas valve 43 is closed, and pump 24 is energized. As water is pumped from the reservoir 85, ice is formed, as at 13 in FIG. 1.

Water level then drops in the reservoir, and reaches a pre-set lower limit sensed by pressure switch 86. Switch 86 then operates flush valve 27 to open condition, so that water pumped from the reservoir flows to drain via duct 27*a*. Also, hot gas valve 43 is opened, as is the water supply valve 87. Once the evaporator is cleared of ice, rising temperature in the space 19 triggers a sensor 96 (see FIG. 1), which in turn transmits signals to close drain valve 27 and shut down the pump. (Note that reservoir water 90 is flushed out while valve 27 remained open and pump 27 operated.) Water level in the reservoir then rises to repeat the cycle.

Figure 8:
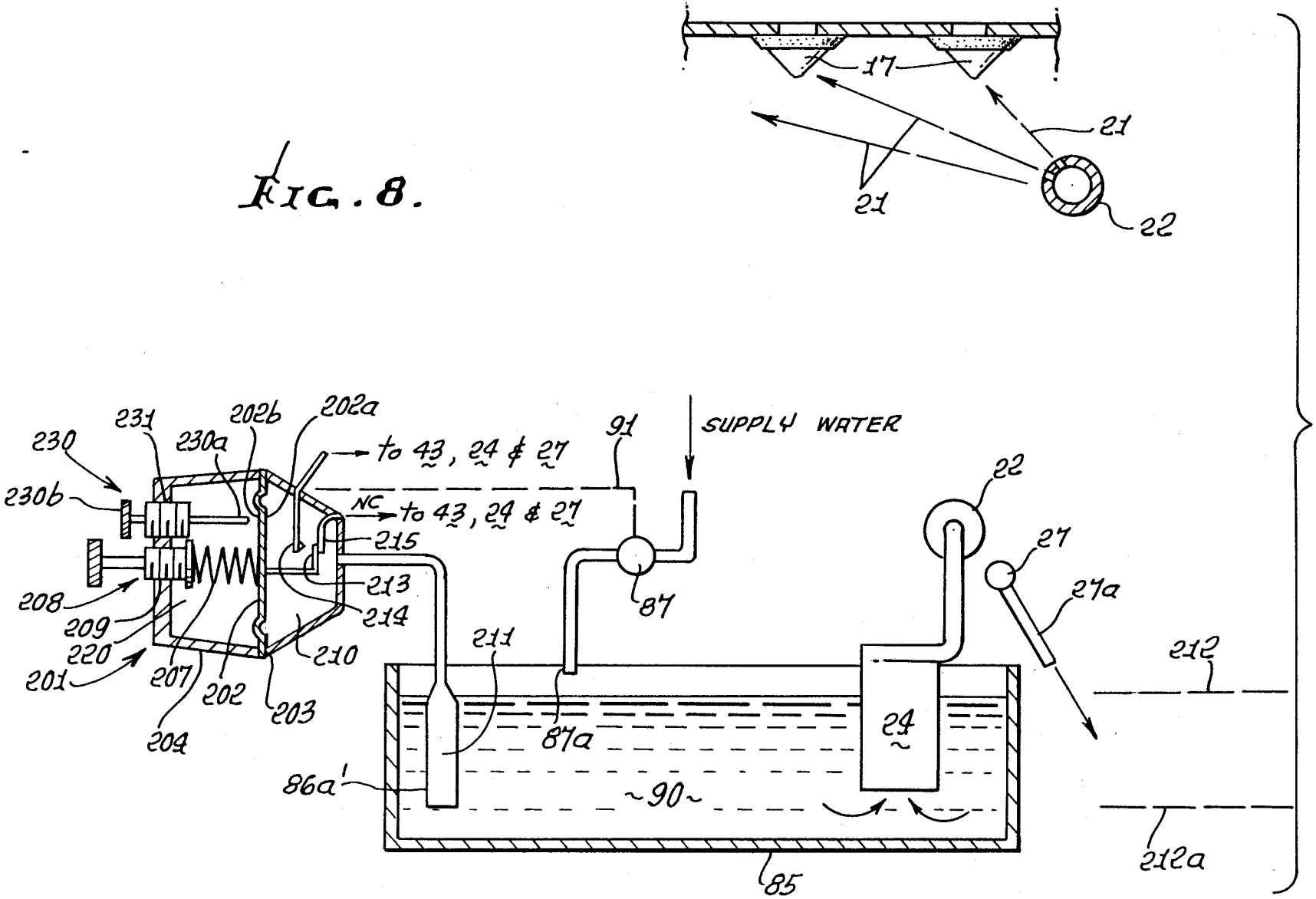
FIG. 8 is a view like FIG. 7 showing a modification.

FIG. 8 shows a modification in which the pressure switch 201 is the same as switch 86 in FIG. 7 except that it is adjustable in order that control of ice-piece size may be achieved. In switch 201, a diaphragm 202 is peripherally mounted at 203 to the case 204. Side 202*a* of the diaphragm is exposed to air pressure in tube enlargement 86*a*′ extending into the water 90 in the reservoir 85; and one end of an adjustable tension coil spring 207 yieldably presses against the opposite side 202*b* of the diaphragm. A set screw 208, threaded at 209 to the case, presses against the opposite end of spring 207. An adjusting set screw 230 is threaded at 231 to the case, and its end 230*a* extends near the diaphragm.

As water level in the reservoir rises, the pressure of the air trapped at 211 in the tube 86*a*′ and in space 210 in switch 201 case increases, and eventually tends to push the diaphragm to the left, i.e., toward the spring to seat against end 230*a* of set screw 230. When the water level reaches a level 212, the diaphragm closes switch contacts 213 and 214 energizing a circuit connected to pump 24, control 27 for valve 43 and control 28 (for valve 27), thereby closing valves 27 and 87, closing hot gas valve 43, and energizing the pump. As water is then pumped from the reservoir 85 and sprayed on 17, ice is formed, as at 13 in FIG. 6.

As water level in the reservoir then drops to level 212*a*, the pressure of air at 210 decreases, and eventually allows spring-urged movement of the diaphragm to the right, closing contacts 213 and 215 and thereby stopping pump 24, opening hot gas valve 43, and opening valves 27 and 87.

It can be seen that by simply adjusting the set screw 230, the water levels 212 and 212*a* can be relatively adjusted closer or further apart. This in turn corresponds to lesser or greater amounts of water sprayed at 21 onto the ice maker means 17, whereby a control of the sizes of the formed ice pieces is very easily achieved simply by rotating set screw knob 230*a* externally of the reservoir without need for adjustment of devices in the reservoir.

Chamber 212 remains at atmospheric pressure.

Accordingly, the ice-making apparatus includes:

(a) first means subject to cooling and heating, and having surface means as at 19, and/or 17, on which ice is to be formed when the surface means is cooled, and from which the pieces separate when the surface means is heated, (b) second means including spray head means, as for example at 22, to spray water on the surface means when cooled, whereby ice progressively forms on the surface means, the second means also includes water reservoir means, as at 85 for example, and means to supply water to the reservoir means and to deliver water from the reservoir means to the spray head means, under the control of water level sensor means for sensing water level in the reservoir means. See for example sensor 201.

The second means may typically include a water pump, as at 24, operatively connected to the reservoir to receive water therefrom for supply to the surface means, the control means including sensor 201 operatively connected with the pump to effect operation thereof when the water level rises to a predetermined level in the reservoir means. The second means may also include a spray head 22 to spray water supplied by the pump onto the surface means. The sensor means may also be operatively connected with heating fluid supply means as via 42 and 43.

Figure 9:
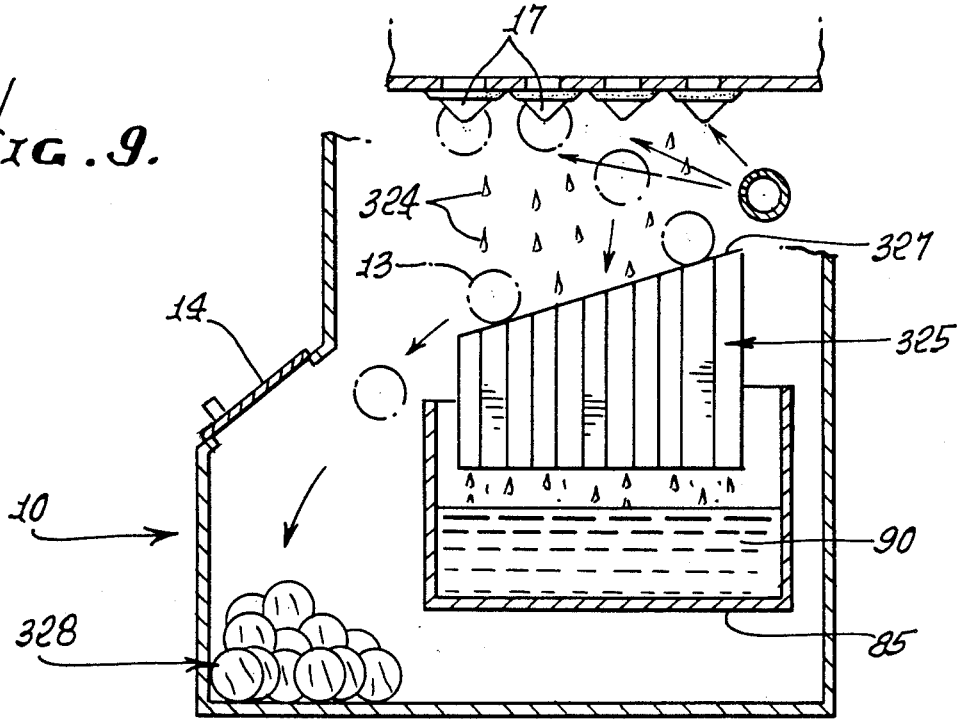
FIG. 9 is a section like FIG. 1 showing a modification.
Figure 10:
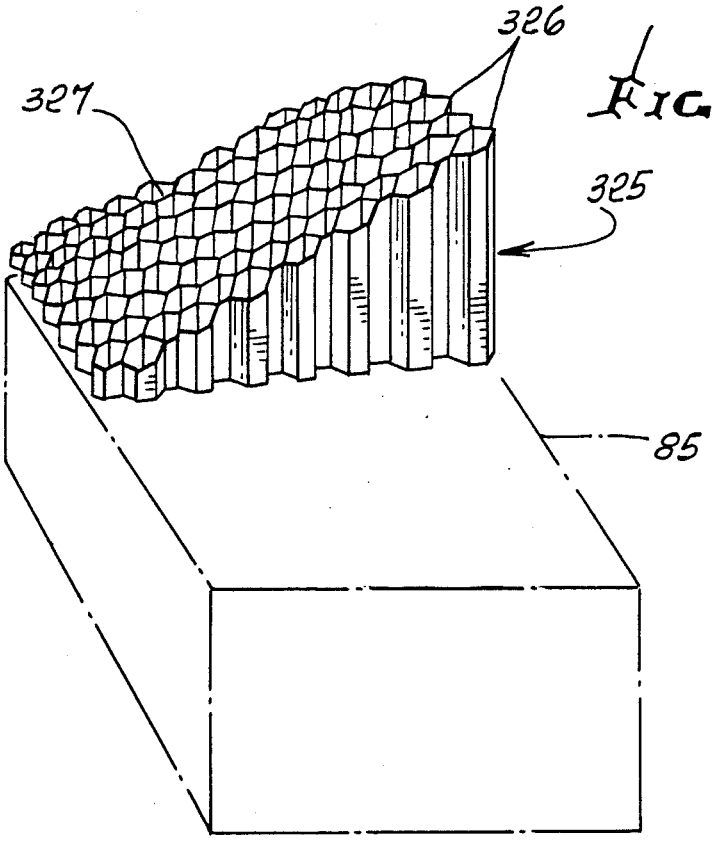
FIG. 10 is a perspective view showing a tube cluster.

In FIGS. 9 and 10, a cluster 325 of ducts 326 extends upwardly above the water 90 in the reservoir means 85. The ducts have open upper and lower ends, and serve to drain water falling (as at 324) from the surface means (as at 17, for example), and into the reservoir. Thus, there is not lateral splash of such falling water, and splash blocking curtains are not needed. Splash-creating chute 30 (of FIG. 1) is also eliminated. Also, the tops of the ducts form an incline 327 onto which the ice pieces 13 fall or drop, to be deflected laterally to slide and drop downwardly for collection at 328. As before, a door 14 in the housing 10 can be opened to gain access to the collected ice pieces.

The structures otherwise shown in FIGS. 9 and 10 correspond to that in FIGS. 1 and 8.

The ducts have cross sections smaller than the cross dimensions of the ice pieces; and the ducts may have various cross-section shapes (circular, hexagonal, etc.)

I claim:

1. In ice-making apparatus, the combination comprising:

(a) first means subject to cooling and heating, and having surface means on which ice is to be formed when said surface means is cooled, and from which ice pieces separate when said surface means is heated, (b) second means including spray head means to spray water on said surface means when cooled, whereby ice progressively forms on said surface means, said second means including water reservoir means, and means to supply water to said reservoir means and to deliver water from the reservoir means to the spray head means, (c) and including a cluster of ducts extending upwardly above the water in the reservoir means to drain water falling from said surface means into the water in the reservoir, the tops of said ducts forming an incline onto which the ice pieces fall to be deflected away from the water reservoir means for collection, (d) the ducts having cross dimensions smaller than the cross dimensions of the ice pieces, and are open ended.

* * * * *